US012704252B2

(12) United States Patent
Sano

(10) Patent No.: US 12,704,252 B2
(45) Date of Patent: Aug. 11, 2026

(54) CEMENT KILN BURNER AND METHOD FOR OPERATING SAME

(71) Applicant: TAIHEIYO CEMENT CORPORATION, Tokyo (JP)

(72) Inventor: Yuya Sano, Tokyo (JP)

(73) Assignee: TAIHEIYO CEMENT CORPORATION, Tokyo (JP)

( * ) Notice: Subject to any disclaimer, the term of this patent is extended or adjusted under 35 U.S.C. 154(b) by 363 days.

(21) Appl. No.: 18/262,273

(22) PCT Filed: Feb. 25, 2021

(86) PCT No.: PCT/JP2021/007050
§ 371 (c)(1),
(2) Date: Jul. 20, 2023

(87) PCT Pub. No.: WO2022/180735
PCT Pub. Date: Sep. 1, 2022

(65) Prior Publication Data
US 2024/0085016 A1 Mar. 14, 2024

(51) Int. Cl.
*F23C 7/00* (2006.01)
*F23C 5/32* (2006.01)
*F23D 1/02* (2006.01)

(52) U.S. Cl.
CPC ..... *F23C 7/002* (2013.01); *F23C 5/32* (2013.01); *F23C 7/004* (2013.01); *F23C 7/008* (2013.01); *F23D 1/02* (2013.01); *F23D 2201/20* (2013.01)

(58) Field of Classification Search
CPC .. F23C 7/002; F23C 5/32; F23C 7/004; F23C 7/008; F23D 1/02; F23D 2201/20
See application file for complete search history.

(56) References Cited

U.S. PATENT DOCUMENTS

2005/0211142 A1 9/2005 Yamamoto et al.
2018/0142887 A1 5/2018 Kiyama et al.

FOREIGN PATENT DOCUMENTS

| | | | |
|---|---|---|---|
| CN | 201706487 | U | 1/2011 |
| CN | 102506426 | | 6/2012 |
| CN | 108613184 | | 10/2018 |
| CN | 109611832 | A | 4/2019 |
| JP | S61-121321 | | 7/1986 |
| JP | H04-009511 | A | 1/1992 |
| JP | 2000-130710 | A | 5/2000 |

(Continued)

OTHER PUBLICATIONS

Office Action issued in Korean Application No. 10-2023-7027328, dated Jan. 16, 2025.

(Continued)

*Primary Examiner* — Michael G Hoang
*Assistant Examiner* — Kurt J Wolford
(74) *Attorney, Agent, or Firm* — Knobbe, Martens, Olson & Bear, LLP

(57) ABSTRACT

A cement kiln burner includes a plurality of columnar or cylindrical flow channels. Outlets of the respective flow channels are disposed on substantially the same plane. A wind velocity adjusting member capable of changing a cross-sectional area at an outlet-side tip-end portion of the flow channel by moving along an axial direction of the flow channel in a state of being in contact with any one of an inner peripheral wall and an outer peripheral wall of the flow channel and not in contact with the other is provided inside at least one of the flow channels.

10 Claims, 9 Drawing Sheets

(56) References Cited

FOREIGN PATENT DOCUMENTS

| | | | |
|---|---|---|---|
| JP | 4261401 | B2 | 4/2009 |
| JP | 2013-237571 | A | 11/2013 |
| JP | 2019-163880 | A | 9/2019 |
| KR | 10-2017-0134705 | A | 12/2017 |

OTHER PUBLICATIONS

Office Action issued in Japanese Application No. 2023-501757, dated Jan. 25, 2024.
International Preliminary Report on Patentability issued in the International Patent Application No. PCT/JP2021/007050, dated Sep. 7, 2023 in 5 pages.
Office Action issued in Korean Patent Application No. 10-2023-7027328 dated Aug. 19, 2025 in 11 pages.
First Office Action issued in Chinese Patent Application No. 202180094539.6 dated Jul. 23, 2025 in 13 pages.
International Search Report for International Application No. PCT/JP2021/007050, dated Apr. 6, 2021 in 3 pages.
Office Action issued in Indonesian Application No. P00202306673, dated Oct. 15, 2025.
Office Action issued in Chinese Application No. 202180094539.6, dated Mar. 14, 2026.
Office Action issued in Chinese Application No. 202180094539.6, dated May 20, 2026.

CEMENT KILN BURNER AND METHOD FOR OPERATING SAME

CROSS-REFERENCE TO RELATED APPLICATIONS

This application is the U.S. National Phase under 35. U.S.C. § 371 of International Application PCT/JP2021/007050, filed Feb. 25, 2021. The disclosure of the above-described application is hereby incorporated by reference in their entirety.

TECHNICAL FIELD

The present invention relates to a cement kiln burner and a method for operating the same.

BACKGROUND ART

In cement production facilities, combustible wastes have been used as substitutes for fuels and raw materials in a rotary kiln (hereinafter referred to as "cement kiln") used for calcining cement clinkers. In recent years, for further use of the combustible wastes, use of combustible wastes having poorer combustibility than before is also increasing. In addition, in order to reduce the cost of coal that has been conventionally used as main fuel, use of coal having poorer combustibility than before is also increasing. Therefore, there is a demand for a technique for simultaneously using conventional combustible waste and coal having relatively good combustibility and combustible waste and coal having poor combustibility.

The structure of a cement kiln burner is disclosed in, for example, Patent Document 1 below. When the velocity of air blown from the burner is increased, the combustibility of fuel blown from the same burner is greatly improved, but when the wind velocity of the burner having the same structure is increased, the airflow rate is also increased at the same time. However, the increase in the airflow rate causes deterioration in the basic unit of heat quantity because fuel for warming the air also needs to be consumed.

PRIOR ART DOCUMENTS

Patent Document

Patent Document 1: JP-A-2013-237571

SUMMARY OF THE INVENTION

Problems to be Solved by the Invention

Meanwhile, when the burner is manufactured, which has a reduced cross-sectional area of a flow channel for blowing out the air so as to increase the wind velocity in consideration of the above, the combustibility of the fuel can be always maintained in a good state, but when fuel having relatively good combustibility is blown, the combustibility is excessively improved, to cause abnormal short flame, which causes quality abnormality of clinkers, burning of refractory bricks on the inner wall of a kiln, and the like. Therefore, the amount, type, and coal type of the conventionally applied coal substitution are limited. Under such circumstances, a technique capable of adjusting the wind velocity without changing the airflow rate of fluid blown out from the flow channel according to the degree of the combustibility of the fuel is desired.

Therefore, an object of the present invention is to provide a cement kiln burner capable of adjusting a wind velocity without changing the airflow rate of fluid blown out from flow channels according to the degree of combustibility of fuel, and a method for operating the same.

Means for Solving the Problems

A cement kiln burner of the present invention includes a plurality of columnar or cylindrical flow channels. Outlets of the respective flow channels are disposed on substantially the same plane. A wind velocity adjusting member capable of changing a cross-sectional area at an outlet-side tip-end portion of the flow channel by moving along an axial direction of the flow channel in a state of being in contact with any one of an inner peripheral wall and an outer peripheral wall of the flow channel and not in contact with the other is provided inside at least one of the flow channels.

According to the present invention, by changing the cross-sectional area at the outlet-side tip-end portion of the flow channel by the wind velocity adjusting member, a wind velocity can be adjusted without changing the airflow rate of fluid blown out from the flow channel according to the degree of combustibility of fuel.

In the cement kiln burner of the present invention, the flow channel provided with the wind velocity adjusting member may be configured to form straight air flows. According to this configuration, the wind velocity can be adjusted without changing the airflow rate of the straight air flows.

In the cement kiln burner of the present invention, the flow channel provided with the wind velocity adjusting member may be configured to form swirl air flows having a swirl angle of 1 to 60 degrees. According to this configuration, the wind velocity can be adjusted without changing the airflow rate of the swirl air flows.

In the cement kiln burner of the present invention, each of the plurality of flow channels may be provided with the wind velocity adjusting member. According to this configuration, the airflow rate of the fluid blown out from each of the flow channels can be appropriately adjusted by each of the wind velocity adjusting members.

In the cement kiln burner of the present invention, the wind velocity adjusting member may be provided inside a cylindrical flow channel positioned on an outermost side among the plurality of flow channels. The cylindrical flow channel positioned on an outermost side has a role of collecting primary air in the other flow channels, and therefore the combustibility of the fuel can be easily adjusted by adjusting the wind velocity of the outermost flow channel.

A method for operating a cement kiln burner according to the present invention is a method for operating a cement kiln burner according to any one of the above items, the method including: reducing a cross-sectional area at a tip-end portion of the flow channel by advancing the wind velocity adjusting member toward the outlet side when increasing the wind velocity of the fluid blown out from the flow channel provided with the wind velocity adjusting member; and increasing the cross-sectional area at the tip-end portion of the flow channel by retracting the wind velocity adjusting member from the outlet side when decreasing the wind velocity of the fluid blown out from the flow channel.

According to the present invention, by changing the cross-sectional area at the outlet-side tip-end portion of the flow channel by the wind velocity adjusting member, a wind velocity can be adjusted without changing the airflow rate of fluid blown out from the flow channel according to the degree of combustibility of fuel.

MODE FOR CARRYING OUT THE INVENTION

Figure 1:
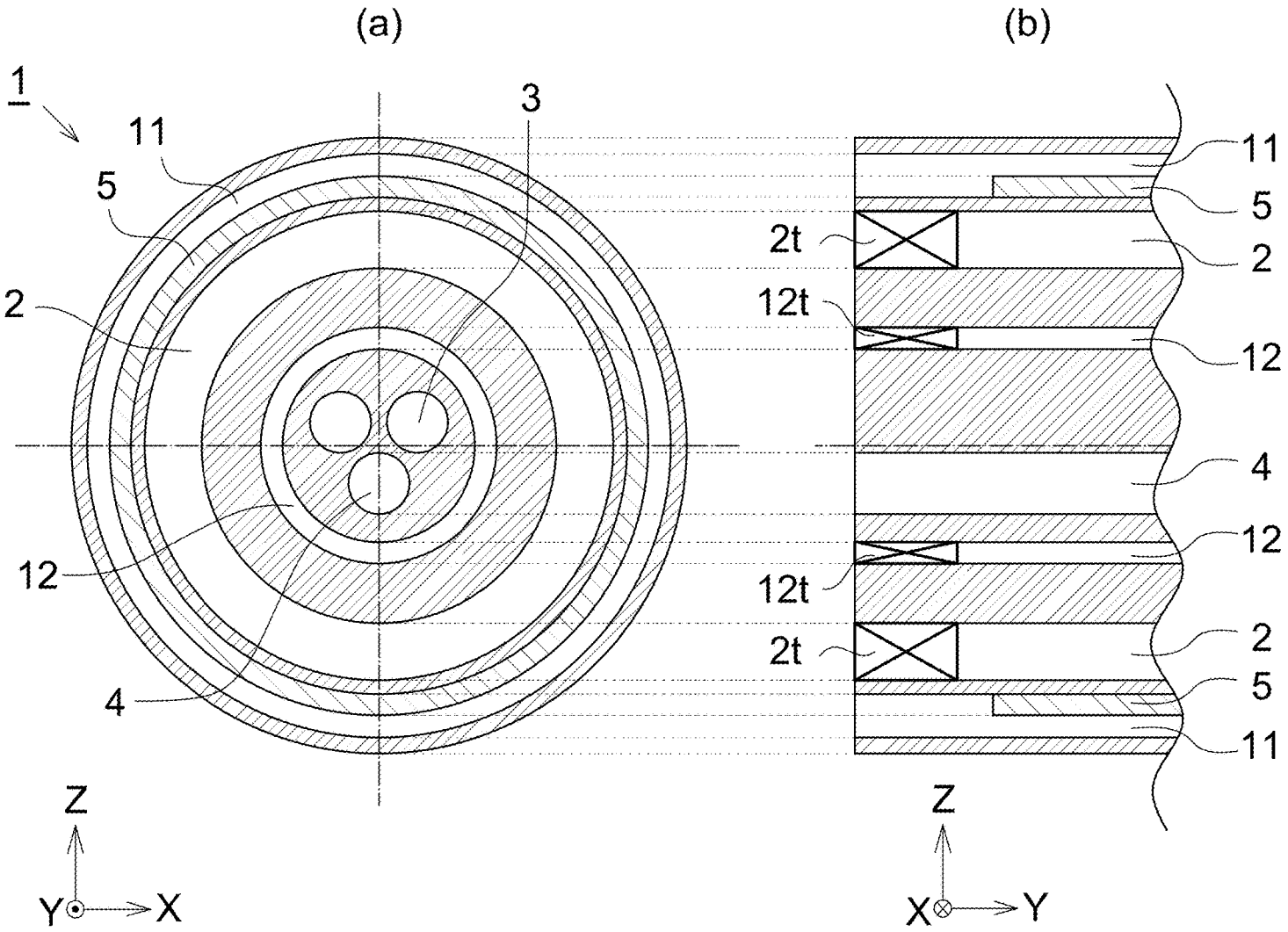
FIG. 1 is a view schematically illustrating a cement kiln burner according to a first embodiment, at its tip-end portion.

Hereinafter, there will be described embodiments of a cement kiln burner and a method for operating the same, according to the present invention, with reference to the drawings. Incidentally, the drawings which will be described later are schematically illustrated, and dimension ratios in the drawings are not coincident with the actual dimension ratios.

First Embodiment

FIG. 1 is a view schematically illustrating a cement kiln burner according to a first embodiment, at its tip-end portion. In FIG. 1, (a) is a transverse cross-sectional view of the cement kiln burner, and (b) is a longitudinal cross-sectional view of the same. Further, the transverse cross-sectional view refers to a cross-sectional view of the cement kiln burner taken along a plane orthogonal to the axial direction of the same. The longitudinal cross-sectional view refers to a cross-sectional view of the cement kiln burner taken along a plane parallel to the axial direction of the same.

Further, in FIG. 1, there is defined a coordinate system, by defining the axial direction of the cement kiln burner (namely, the direction of air flows) as a Y direction, by defining the vertical direction as a Z direction, and by defining the direction orthogonal to a YZ plane as an X direction. Hereinafter, descriptions will be given by appropriately referring to the XYZ coordinate system. By using this XYZ coordinate system, FIG. 1(*a*) corresponds to a cross-sectional view of the cement kiln burner, taken along an XZ plane, and FIG. 1(*b*) corresponds to a cross-sectional view of the cement kiln burner, taken along the YZ plane. More specifically. FIG. 1(*b*) corresponds to a cross-sectional view of the cement kiln burner, taken along the YZ plane, at a position near the burner tip.

As illustrated in FIG. 1, a cement kiln burner 1 includes plural flow channels in a concentric manner. More specifically, the cement kiln burner 1 includes a powdered-solid-fuel flow channel 2, a first air flow channel 11 disposed adjacent to and outside the powdered-solid-fuel flow channel 2, and a second air flow channel 12 disposed adjacent to and on the inside of the powdered-solid-fuel flow channel 2. Further, an oil flow channel 3, a combustible-solid-waste flow channel 4 and the like are disposed on the inside of the second air flow channel 12. Outlets of these flow channels are disposed on substantially the same plane.

In the powdered-solid-fuel flow channel 2 and the second air flow channel 12, out of the powdered-solid-fuel flow channel 2 and the first and second air flow channels 11 and 12, swirl vanes (2*t*, 12*t*) as respective swirl means are secured to the burner tip-end portions in the respective flow channels (see FIG. 1(*b*)). Namely, air flows ejected from the second air flow channel 12 form swirl air flows (which will be properly referred to as "swirl inner flows", hereinafter) positioned on the inside of powdered-solid-fuel flow ejected from the powdered-solid-fuel flow channel 2. Further, the respective swirl vanes (2*t*, 12*t*) are adjustable in swirl angle, at the time point before the start of operation of the cement kiln burner 1. The swirl angle is set to 1 to 60 degrees, for example.

Meanwhile, no swirl means is provided in the first air flow channel 11. Namely, air flows ejected from the first air flow channel 11 form straight air flows (which will be properly referred to as "straight outer flows", hereinafter) positioned outside powdered-solid-fuel flows ejected from the powdered-solid-fuel flow channel 2.

A wind velocity adjusting member 5 is provided inside the first air flow channel 11. By moving the wind velocity adjusting member 5 along the axial direction of the first air flow channel 11, the wind velocity can be adjusted without changing the airflow rate of the air blown out from the first air flow channel 11 (will be described in detail later).

Figure 2:
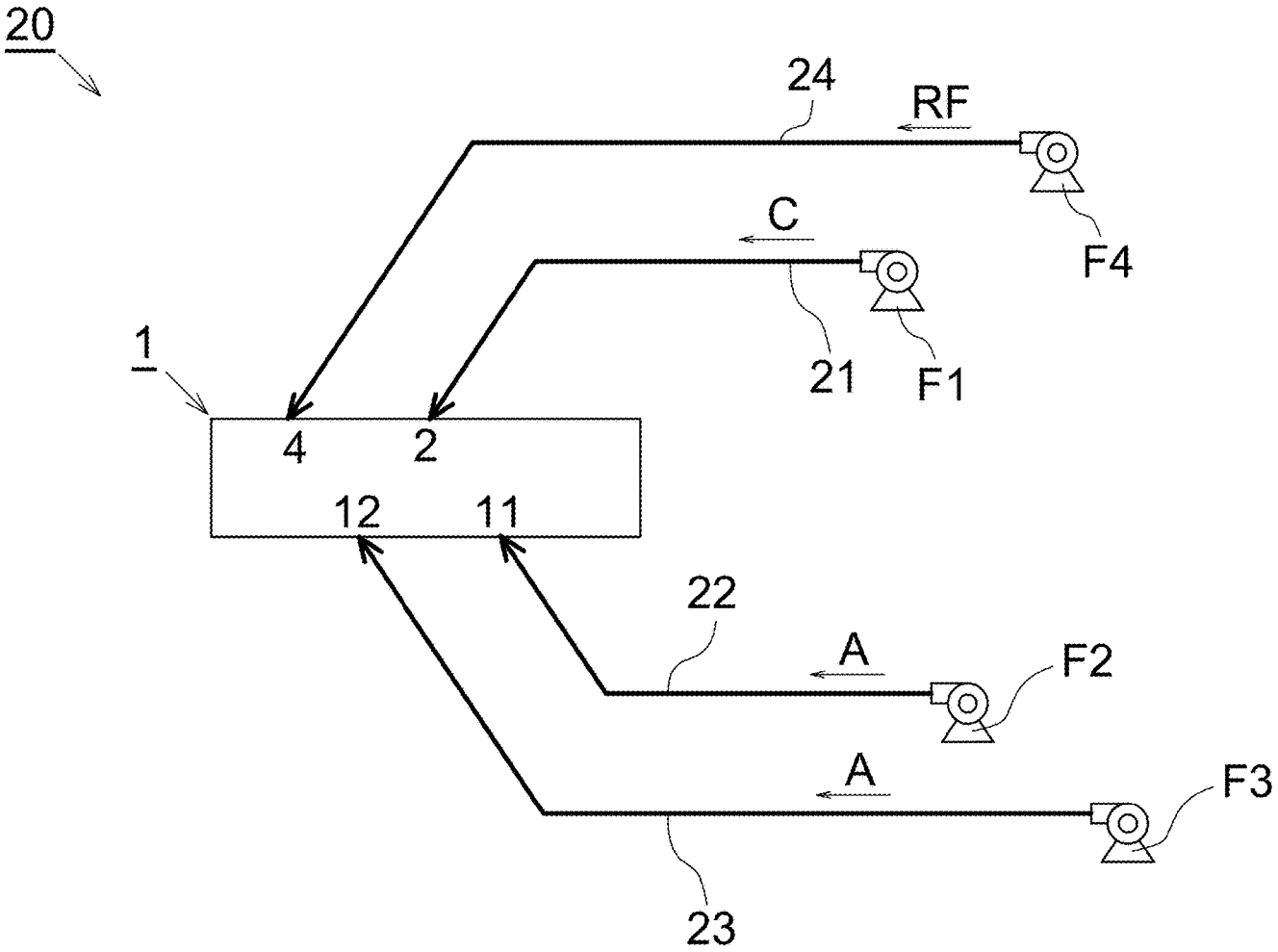
FIG. 2 is a view schematically illustrating an example of the structure of a cement kiln burner system including the cement kiln burner illustrated in FIG. 1.

FIG. 2 is a view schematically illustrating an example of the structure of a cement kiln burner system including the cement kiln burner 1 illustrated in FIG. 1. A cement kiln burner system 20 illustrated in FIG. 2 is structured in such a way as to place importance on facilitating the control, and this cement kiln burner system 20 includes four blowing fans F1 to F4 without limitation.

Pulverized coal C (one example of "powdered solid fuel") supplied to a pulverized-coal transfer pipe 21 is supplied to the powdered-solid-fuel flow channel 2 in the cement kiln burner 1, through air flows formed by the blowing fan F1. Air supplied from the blowing fan F2 is supplied, as combustion air A, to the first air flow channel 11 in the cement kiln burner 1, through an air pipe 22. Air supplied from the blowing fan F3 is supplied, as combustion air A, to the second air flow channel 12 in the cement kiln burner 1, through an air pipe 23. A combustible solid waste RF supplied to a combustible-solid-waste transfer pipe 24 is supplied to the combustible-solid-waste flow channel 4 in the cement kiln burner 1, through air flows formed by the blowing fan F4.

The cement kiln burner system 20 illustrated in FIG. 2 is capable of controlling the amount of air flowing through each of the flow channels (2, 4, 11, 12), independently, through the blowing fans (F1 to F4).

Further, heavy oil or the like can be also supplied, through the oil flow channel 3, for being used in ignition in the cement kiln burner 1. Also, solid fuel other than pulverized coal or liquid fuel such as heavy oil can be supplied thereto, for being used in mixed combustion together with pulverized coal, during normal operation (not illustrated).

Figure 3:
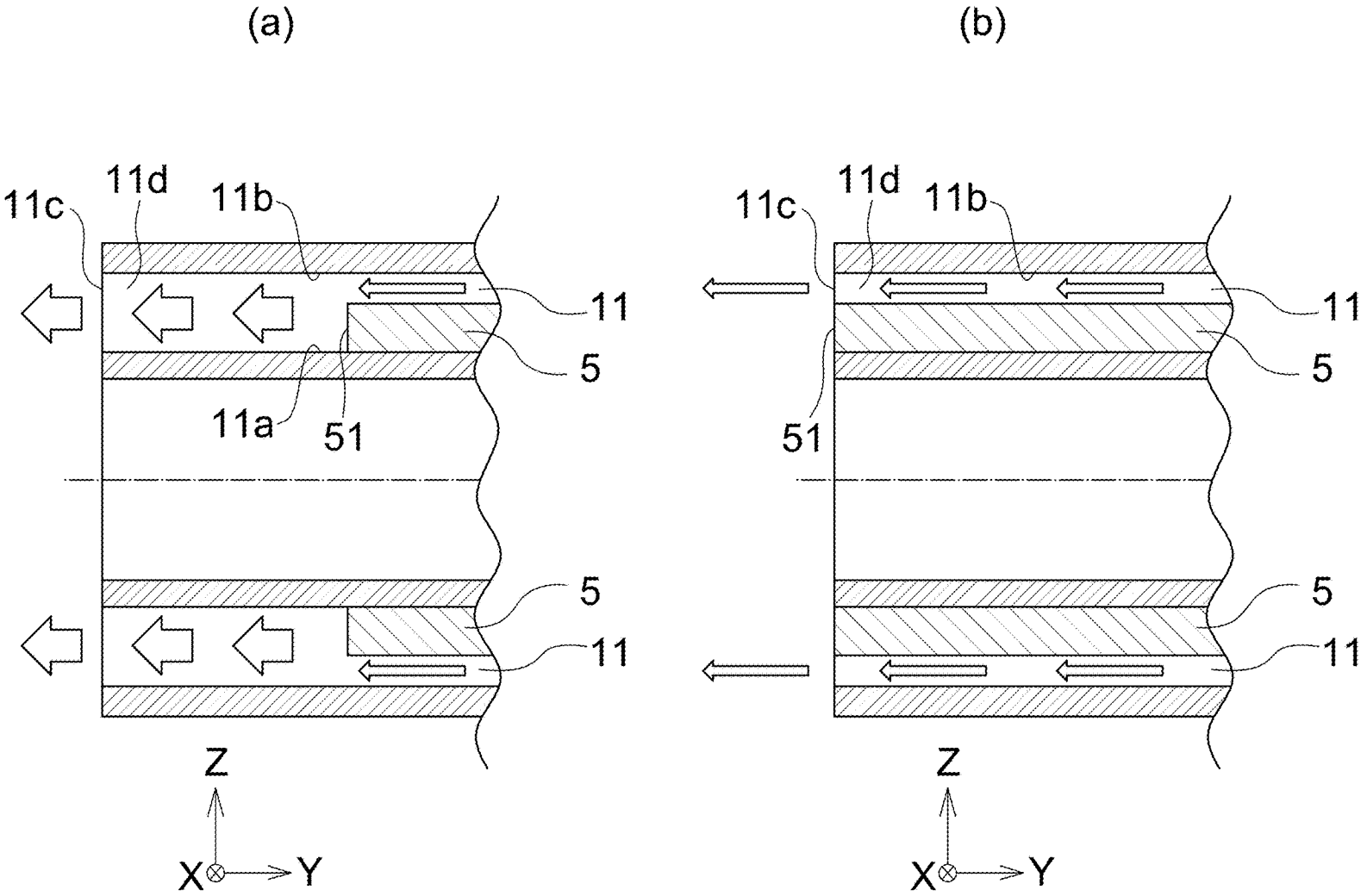
FIG. 3 is a view schematically illustrating the movement of a wind velocity adjusting member and the influence of the wind velocity adjusting member on a wind velocity according to the first embodiment.

FIG. 3 is a view schematically illustrating the movement of the wind velocity adjusting member 5 and the influence of the wind velocity adjusting member 5 on a wind velocity. In FIG. 3, for convenience of explanation, flow channels other than the first air flow channel 11 are not illustrated. The wind velocity adjusting member 5 of the first embodiment is a circular tubular member that is in contact with the inner peripheral wall 11*a* of the first air flow channel 11 and is not in contact with the outer peripheral wall 11*b* of the first air flow channel 11. Namely, the inner diameter of the wind velocity adjusting member 5 is the same as the diameter of the inner peripheral wall 11*a* of the first air flow channel 11, and the outer diameter of the wind velocity adjusting member 5 is smaller than the diameter of the outer peripheral wall 11*b* of the first air flow channel 11.

The wind velocity adjusting member 5 is configured to be movable along the axial direction (Y direction) in the first air flow channel 11. The wind velocity adjusting member 5 is moved along the axial direction by a frontward-rearward moving mechanism (for example, a rack and pinion mechanism) (not illustrated).

The wind velocity adjusting member 5 can change the cross-sectional area at the outlet 11*c*-side tip-end portion 11*d* of the first air flow channel 11 by moving along the axial direction in the first air flow channel 11. In FIG. 3, (a) illustrates a state where the wind velocity adjusting member 5 is retracted from the outlet 11*c* side of the first air flow channel 11, and (b) illustrates a state where the wind velocity adjusting member 5 is advanced toward the outlet 11*c* side of the first air flow channel 11. In the state illustrated in FIG. 3(*a*), the cross-sectional area of the tip-end portion 11*d* of the first air flow channel 11 is larger than that in the state illustrated in FIG. 3(*b*), and therefore the wind velocity of the air blown out from the first air flow channel 11 is small. Meanwhile, in the state illustrated in FIG. 3(*b*), the cross-sectional area of the tip-end portion 11*d* of the first air flow channel 11 is smaller than that in the state illustrated in FIG. 3(*a*), and therefore the wind velocity of the air blown out from the first air flow channel 11 is large even when the airflow rate of supplied air is the same. The wind velocity adjusting member 5 is movable to an optional position other than the states illustrated in FIGS. 3(*a*) and 3(*b*), and the wind velocity of the air blown out from the first air flow channel 11 can be appropriately adjusted by changing the distance between the tip-end 51 of the wind velocity adjusting member 5 and the outlet 11*c* of the first air flow channel 11. Therefore, by moving the wind velocity adjusting member 5 along the axial direction of the first air flow channel 11, the wind velocity can be adjusted without changing the airflow rate of the air blown out from the first air flow channel 11.

As described above, the cement kiln burner 1 according to the first embodiment illustrated in FIGS. 1 to 3 is the cement kiln burner 1 having the plurality of columnar or cylindrical flow channels (2, 3, 4, 11, 12), and outlets of the respective flow channels (2, 3, 4, 11, 12) are disposed on substantially the same plane. Inside the first air flow channel 11, a wind velocity adjusting member 5 is provided. The wind velocity adjusting member 5 can change the cross-sectional area at the outlet 11*c*-side tip end portion 11*d* of the first air flow channel 11 by moving along the axial direction of the first air flow channel 11 in a state of being in contact with the inner peripheral wall 11*a* of the first air flow channel 11 and not in contact with the outer peripheral wall lib of the first air flow channel 11.

The method for operating the cement kiln burner 1 according to the first embodiment reduces the cross-sectional area at the tip-end portion 11*d* of the first air flow channel 11 by advancing the wind velocity adjusting member 5 toward the outlet 11*c*-side of the first air flow channel 11 when increasing the wind velocity of straight outer flows blown out from the first air flow channel 11. As a result, for example, when fuel having poor combustibility is used, the wind velocity of straight outer flows blown out from the first air flow channel 11 can be increased to promote combustion. The method for operating the cement kiln burner 1 according to the first embodiment increases the cross-sectional area at the tip-end portion 11*d* of the first air flow channel 11 by retracting the wind velocity adjusting member 5 from the outlet 11*c* side of the first air flow channel 11 when decreasing the wind velocity of straight outer flows blown out from the first air flow channel 11. As a result, for example, when fuel having good combustibility is used, the wind velocity of straight outer flows blown out from the first air flow channel 11 can be lowered to delay combustion.

Second Embodiment

A second embodiment of a cement kiln burner 1 according to the present invention will be described mainly on differences from the first embodiment. Components common to those of the first embodiment are denoted by the same reference numerals, and the description thereof is appropriately omitted.

In the first embodiment, the example in which the wind velocity adjusting member 5 is provided inside the first air flow channel 11 forming the straight air flows has been described, but the present invention is not limited thereto. For example, as in the second embodiment illustrated in FIG. 4, a wind velocity adjusting member 5 may be provided in a second air flow channel 12 forming swirl air flows.

Figure 4:
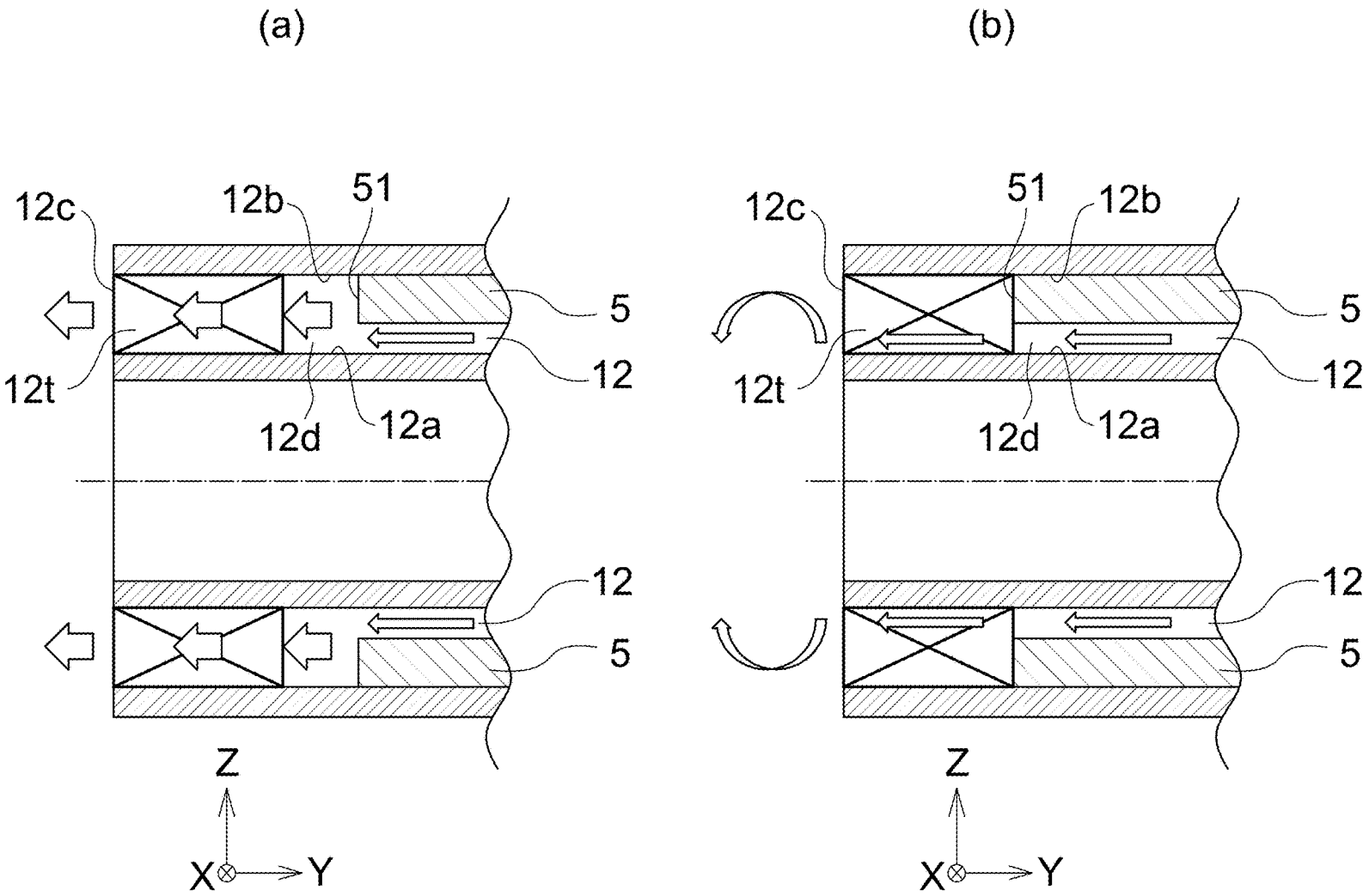
FIG. 4 is a view schematically illustrating the movement of a wind velocity adjusting member and the influence of the wind velocity adjusting member on a wind velocity according to a second embodiment.

FIG. 4 is a view schematically illustrating the movement of a wind velocity adjusting member 5 and the influence of the wind velocity adjusting member 5 on a wind velocity according to a second embodiment. In FIG. 4, for convenience of explanation, flow channels other than the second air flow channel 12 are not illustrated. The wind velocity adjusting member 5 of the second embodiment is a circular tubular member that is in contact with an outer peripheral wall 12*b* of the second air flow channel 12 and is not in contact with an inner peripheral wall 12*a* of the second air flow channel 12.

The wind velocity adjusting member 5 can change the cross-sectional area at the outlet 12*c*-side tip-end portion 12*d* of the second air flow channel 12 by moving along the axial direction in the second air flow channel 12. In FIG. 4, (a) illustrates a state where the wind velocity adjusting member 5 is retracted from the outlet 12*c* side of the second air flow channel 12, and (b) illustrates a state where the wind velocity adjusting member 5 is advanced toward the outlet 12*c* side of the second air flow channel 12. In the state illustrated in FIG. 4(*a*), the cross-sectional area of the tip-end portion 12*d* of the second air flow channel 12 is larger than that in the state illustrated in FIG. 4(*b*), and therefore the wind velocity of the air blown out from the second air flow channel 12 is small. Meanwhile, in the state illustrated in FIG. 4(*b*), the cross-sectional area of the tip-end portion 12*d* of the second air flow channel 12 is smaller than that in the state illustrated in FIG. 4(*a*), and therefore the wind velocity of the air blown out from the second air flow channel 12 is large even when the airflow rate of supplied air is the same. The wind velocity adjusting member 5 is movable to an optional position other than the states illustrated in FIGS. 4(*a*) and 4(*b*), and the wind velocity of the air blown out from the second air flow channel 12 can be appropriately adjusted by changing the distance between the tip-end 51 of the wind velocity adjusting member 5 and the outlet 12*c* of the second air flow channel 12. Therefore, by moving the wind velocity adjusting member 5 along the axial direction of the second air flow channel 12, the wind velocity can be adjusted without changing the airflow rate of the air blown out from the second air flow channel 12. Furthermore, the wind velocity of the air supplied to a swirl vane 12*t* changes, and therefore a swirl angle in the state illustrated in FIG. 4(*b*) becomes larger than that in the state illustrated in FIG. 4(*a*). The increase of the swirl angle of swirl air flows can further facilitate combustion.

Third Embodiment

A third embodiment of a cement kiln burner 1 according to the present invention will be described mainly on differences from the second embodiment. Components common to those of the second embodiment are denoted by the same reference numerals, and the description thereof is appropriately omitted.

In the second embodiment, the swirl vane 12*t* is provided so as to completely close the outlet 12*c* of the second air flow channel 12, but the present invention is not limited thereto. For example, as in the third embodiment illustrated in FIG. 5, a swirl vane 12*t* may be provided so as to close only a part of an outlet 12*c* of a second air flow channel 12. In this example, the swirl vane 12*t* has a circular tubular shape and is in contact with an inner peripheral wall 12*a* of the second air flow channel 12 and is not in contact with an outer peripheral wall 12*b* of the second air flow channel 12. The inner diameter of the wind velocity adjusting member 5 is larger than the outer diameter of the swirl vane 12*t*, and the wind velocity adjusting member 5 can move to the outlet 12*c* of the second air flow channel 12 along the axial direction outside the swirl vane 12*t*.

Figure 5:
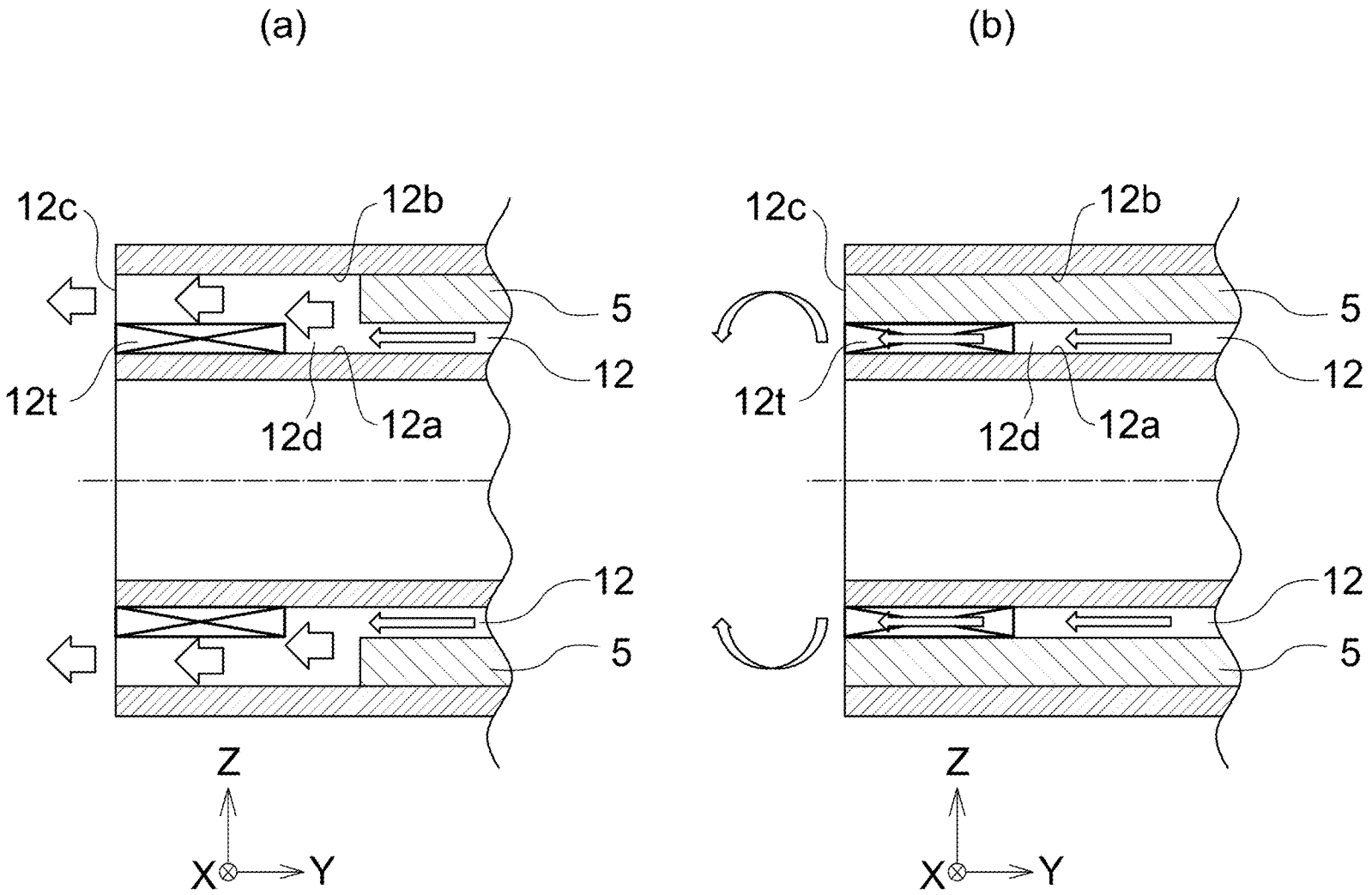
FIG. 5 is a view schematically illustrating the movement of a wind velocity adjusting member and the influence of the wind velocity adjusting member on a wind velocity according to a third embodiment.

FIG. 5 is a view schematically illustrating the movement of a wind velocity adjusting member 5 and the influence of the wind velocity adjusting member 5 on a wind velocity according to a third embodiment. In FIG. 5, for convenience of explanation, flow channels other than the second air flow channel 12 are not illustrated. The wind velocity adjusting member 5 of the third embodiment has the same shape as that of the wind velocity adjusting member 5 of the second embodiment.

By moving the wind velocity adjusting member 5 along the axial direction of the second air flow channel 12, the wind velocity can be adjusted without changing the airflow rate of the air blown out from the second air flow channel 12. Furthermore, a swirl angle by the swirl vane 12*t* can also be adjusted by changing the airflow rate of the air supplied to the swirl vane 12*t*. In the state illustrated in FIG. 5(*a*), the air hardly passes through the swirl vane 12*t*, and therefore the swirl angle of air flows blown out from the second air flow channel 12 becomes substantially 0. Meanwhile, most of the air passes through the swirl vane 12*t* in the state illustrated in FIG. 5(*b*), and therefore the swirl angle of the air flows blown out from the second air flow channel 12 increases.

Note that the configuration of the cement kiln burner is not limited to that of the above-described embodiments, and the functions and effects of the cement kiln burner are not limited to those of the above-described embodiments. It is needless to say that various modifications can be made to the cement kiln burner without departing from the gist of the present invention. For example, the configurations, methods, and the like of the plurality of embodiments described above may be optionally adopted and combined. It is a matter of course that one or two or more of configurations, methods, and the like according to various modifications described below may be optionally selected and adopted for the configurations, methods, and the like according to the embodiments described above.

(1) In the first to third embodiments described above, the wind velocity adjusting member 5 is provided inside the cylindrical first or second air flow channel 11 or 12, but the present invention is not limited thereto. For example, the wind velocity adjusting member 5 may be provided inside the columnar combustible-solid-waste flow channel 4 or the cylindrical powdered-solid-fuel flow channel 2 illustrated in FIG. 1. The wind velocity adjusting member may be provided inside each of the plurality of flow channels.

Figure 6:
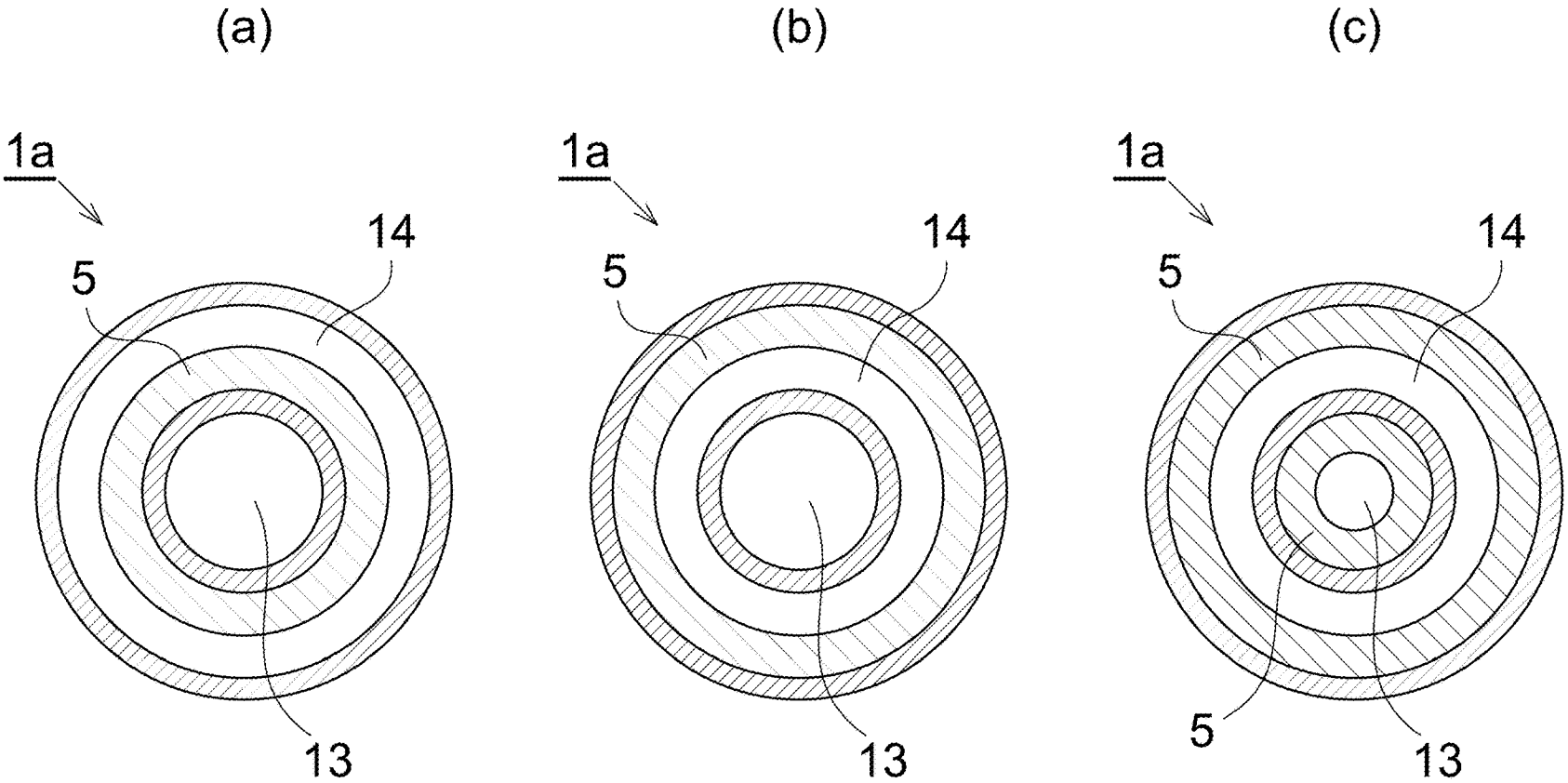
FIG. 6 is a transverse cross-sectional view of a cement kiln burner according to another embodiment.

(2) FIG. 6 is a transverse cross-sectional view of a cement kiln burner according to another embodiment. A cement kiln burner 1*a* illustrated in FIG. 6 is a calcining furnace burner installed at a kiln tail portion of a cement kiln (see FIG. 9). Namely, the cement kiln burner of the present invention includes not only a main fuel burner provided at a furnace front portion of a cement kiln, but also a burner (also referred to as calcining furnace burner) provided in a calcining furnace attached to the cement kiln.

The cement kiln burner 1*a* illustrated in FIG. 6 includes a columnar pulverized coal flow channel 13 and a diffusion air flow channel 14 disposed adjacent to and outside the pulverized coal flow channel 13. In an example of FIG. 6(*a*), the wind velocity adjusting member 5 is provided, which can change the cross-sectional area at the outlet-side tip-end portion of the diffusion air flow channel 14 by moving along the axial direction of the diffusion air flow channel 14 in a state of being in contact with the inner peripheral wall of the diffusion air flow channel 14 and not in contact with the outer peripheral wall of the diffusion air flow channel 14. In an example of FIG. 6(*b*), the wind velocity adjusting member 5 is provided, which can change the cross-sectional area at the outlet-side tip-end portion of the diffusion air flow channel 14 by moving along the axial direction of the diffusion air flow channel 14 in a state of being in contact with the outer peripheral wall of the diffusion air flow channel 14 and not in contact with the inner peripheral wall of the diffusion air flow channel 14. In an example of FIG. 6(*c*), in addition to the wind velocity adjusting member 5 of FIG. 6(*b*), the wind velocity adjusting member 5 is provided, which can change the cross-sectional area at the outlet-side tip-end portion of the pulverized coal flow channel 13 by moving along the axial direction of the pulverized coal flow channel 13 in a state of being in contact with the outer peripheral wall of the pulverized coal flow channel 13. As in the example of FIG. 6(*c*), the wind velocity adjusting member 5 may be provided inside each of the plurality of flow channels.

Figure 7:
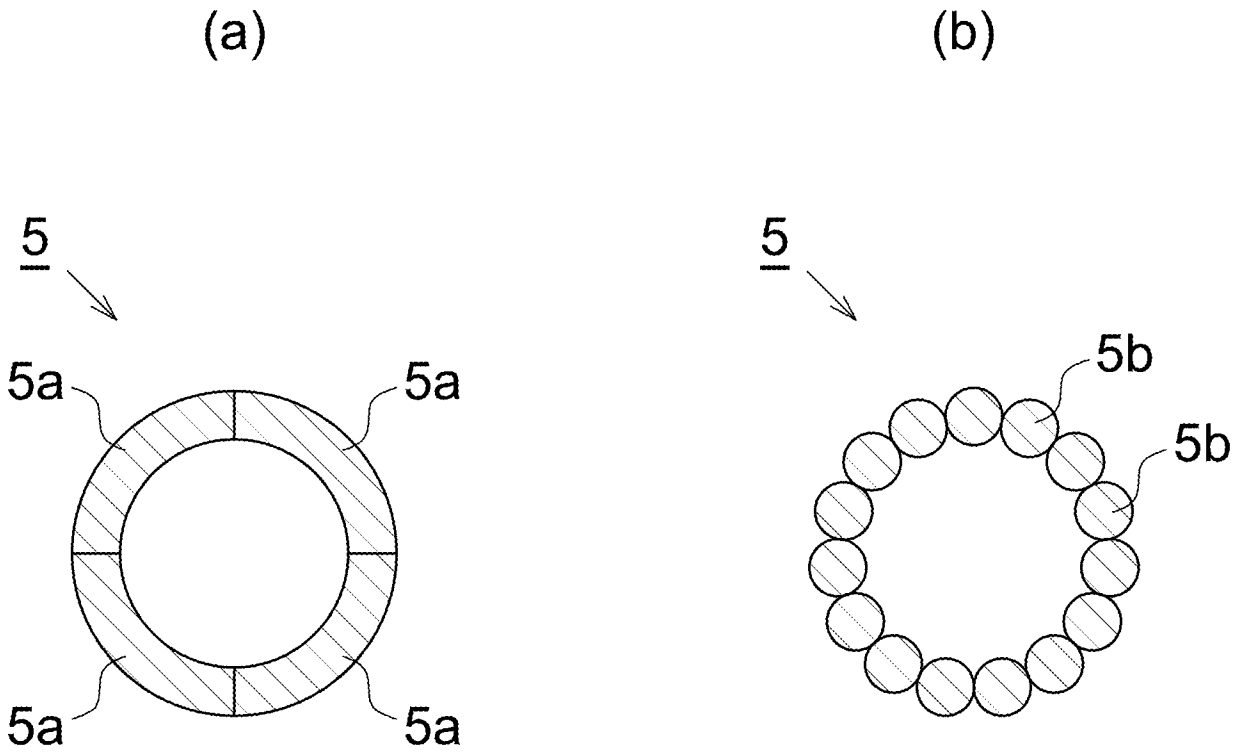
FIG. 7 is a transverse cross-sectional view of a wind velocity adjusting member according to another embodiment.

(3) In the above-described embodiments, the wind velocity adjusting member 5 is an integrally formed circular tubular member, but the present invention is not limited thereto. For example, as illustrated in FIG. 7(*a*), the wind velocity adjusting member 5 may be a circular tubular member divided into a plurality of parts in the circumferential direction. In this example, the wind velocity adjusting member 5 is divided into four wind velocity adjusting members 5*a*, and the wind velocity adjusting members 5*a* can each independently move along the axial direction. According to this configuration, it is possible to selectively move the wind velocity adjusting member 5*a* at a portion where the wind velocity is desired to be increased while observing a flame situation.

At least one of the four wind velocity adjusting members 5*a* illustrated in FIG. 7(*a*) may be provided as the wind velocity adjusting member. Namely, it is not necessary to provide the wind velocity adjusting members over the entire circumference of the flow channel, and the wind velocity adjusting members may be provided only in a part of the flow channel in the circumferential direction.

As illustrated in FIG. 7(*b*), the wind velocity adjusting member 5 may include a plurality of lance-shaped members 5*b*. The plurality of lance-shaped members 5*b* can each independently move along the axial direction. According to this configuration, it is possible to selectively move the lance-shaped member 5*b* at a portion where the wind velocity is desired to be increased while observing the flame situation.

EXAMPLES

The present inventors evaluated the influence of a wind velocity adjusting member on combustibility by the combustion simulation (software: FLUENT manufactured by ANSYS JAPAN K.K.) of a cement kiln burner.

Example 1

Figure 8:
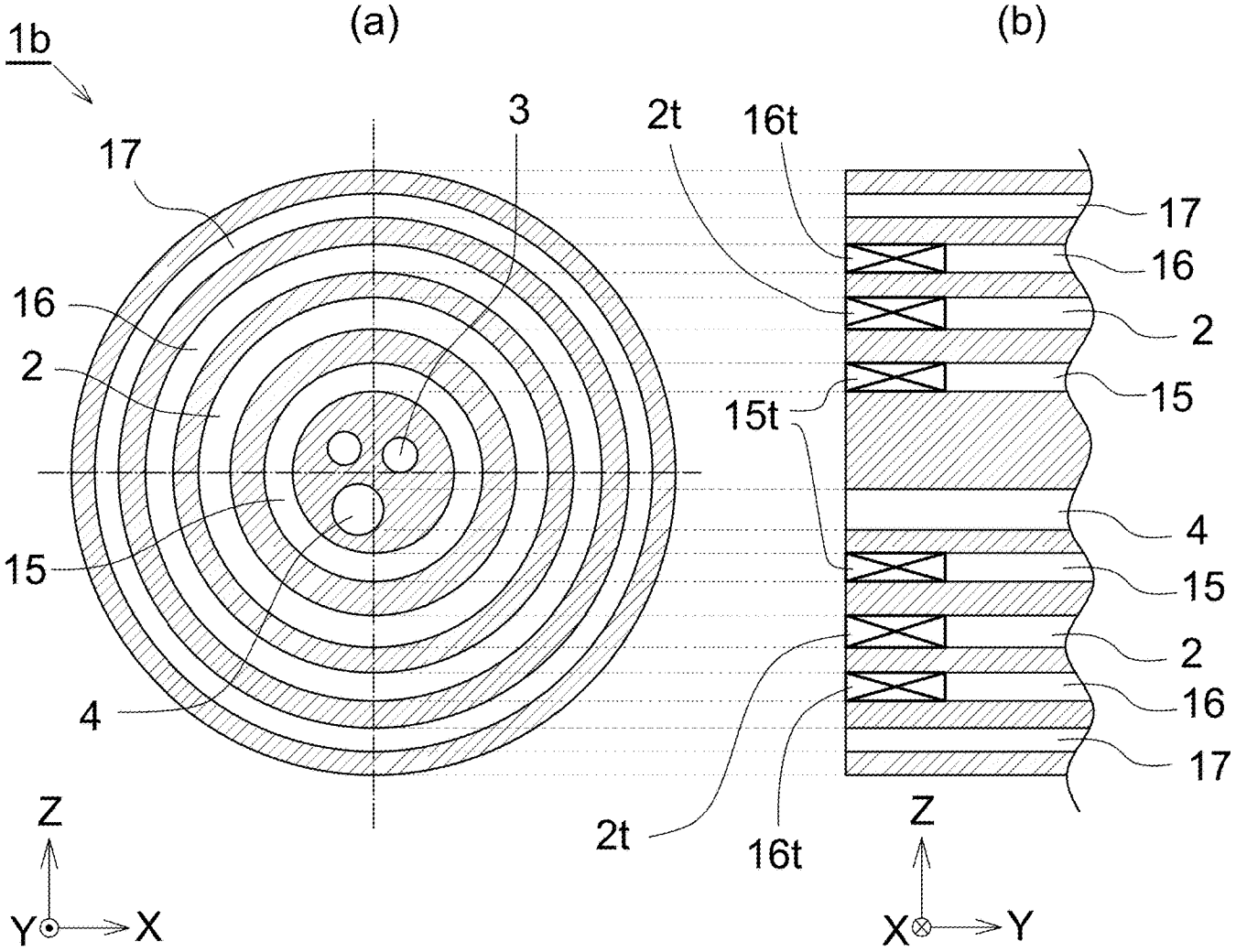
FIG. 8 is a view schematically illustrating a cement kiln burner according to Example 1, at its tip-end portion.

A cement kiln burner 1*b* illustrated in FIG. 8 was analyzed. The cement kiln burner 1*b* includes a powdered-solid-fuel flow channel 2, a swirl inner flow channel 15 disposed adjacent to and on the inside of the powdered-solid-fuel flow channel 2, a swirl outer flow channel 16 disposed adjacent to and outside the powdered-solid-fuel flow channel 2, and a straight outer flow channel 17 disposed adjacent to and outside the swirl outer flow channel 16. Further, an oil flow channel 3, a combustible-solid-waste flow channel 4 and the like are disposed on the inside of the swirl inner flow channel 15. In the powdered-solid-fuel flow channel 2, the swirl inner flow channel 15, and the swirl outer flow channel 16, swirl vanes (2*t*, 15*t*, 16*t*) are respectively fixed to burner tip-end portions of the flow channels. A wind velocity adjusting member is not illustrated in FIG. 8.

<Burner Combustion Conditions>

Combustion amount of pulverized coal as powdered solid fuel: 15 t/hour

Processed amount of waste plastic (non-rigid plastic) as combustible solid waste: 3 t/hour <Waste Plastic Conditions>

Size of waste plastic as combustible solid waste: a circular sheet having a diameter of 30 mm and formed by punching a sheet having a thickness of 0.5 mm <Secondary Air Conditions>

Amount and temperature of secondary air: 150000 $Nm^3$/hour, 800° C.

<Primary Air Conditions>

Using a wind velocity and a primary air ratio at the outlet of the burner in the following Table 1 as a base (specification), the wind velocity adjusting member provided inside the flow channel was moved from a position where the wind velocity adjusting member was pulled out by 0.5 m from the outlet of the burner to a position where the wind velocity adjusting member was pushed into the outlet (0 m) of the burner. The wind velocity adjusting member was provided in only one of flow channels (2, 4, 15, 16, 17), and moved. A wind velocity when the distance between the tip of the wind velocity adjusting member and the outlet of the burner was 0.5 m and a wind velocity when the distance between the tip of the wind velocity adjusting member and the outlet of the burner was 0 m were as shown in Table 2 below.

<Evaluation Items>

The falling rate of waste plastic when the distance between the tip of the wind velocity adjusting member and the outlet of the burner was changed was subjected to simulation analysis. The falling rate of the waste plastic is a ratio of the falling waste plastic among the discharged waste plastic. The evaluation results of the falling rate (% by volume) of the waste plastic are shown in Table 3.

TABLE 1

| Flow channel name | Wind velocity at outlet of burner of base m/s | Primary air ratio % by volume | Swirl angle Degree |
|---|---|---|---|
| Combustible-solid-waste flow channel | 50 | 3.5 | 0 |
| Swirl inner flow channel | 150 | 2.0 | 30 |
| Powdered-solid-fuel flow channel | 50 | 3.5 | 10 |
| Swirl outer flow channel | 150 | 2.0 | 30 |
| Straight outer flow channel | 250 | 3.0 | 0 |

TABLE 2

| | Distance between tip of wind velocity adjusting member and outlet of burner | |
|---|---|---|
| | 0.5 m | 0 m |
| Flow channel name | Wind velocity at outlet of burner m/s | |
| Combustible-solid-waste flow channel | 30 | 80 |
| Swirl inner flow channel | 100 | 240 |
| Powdered-solid-fuel flow channel | 30 | 80 |
| Swirl outer flow channel | 100 | 240 |
| Straight outer flow channel | 100 | 400 |

TABLE 3

| Falling rate of waste plastic [% by volume] | | | | | | | | |
|---|---|---|---|---|---|---|---|---|
| | Distance between tip of wind velocity adjusting member and outlet of burner [m] | | | | | | | |
| Flow channel name | 0.50 | 0.40 | 0.30 | 0.20 | 0.10 | 0.05 | 0.02 | 0.00 |
| Combustible-solid-waste flow channel | 12 | 12 | 12 | 12 | 12 | 11 | 10 | 9 |
| Swirl inner flow channel | 14 | 14 | 14 | 12 | 10 | 7 | 3 | 1 |
| Powdered-solid-fuel flow channel | 7 | 7 | 7 | 7 | 7 | 6 | 4 | 2 |

TABLE 3-continued

| Falling rate of waste plastic [% by volume] | | | | | | | | |
|---|---|---|---|---|---|---|---|---|
| | Distance between tip of wind velocity adjusting member and outlet of burner [m] | | | | | | | |
| Flow channel name | 0.50 | 0.40 | 0.30 | 0.20 | 0.10 | 0.05 | 0.02 | 0.00 |
| Swirl outer flow channel | 15 | 15 | 15 | 15 | 13 | 10 | 5 | 2 |
| Straight outer flow channel | 20 | 20 | 19 | 17 | 13 | 9 | 5 | 0 |

As shown in Table 3, by advancing the wind velocity adjusting member toward the outlet side of the burner and increasing the wind velocity, the combustion of the waste plastic was promoted, and therefore the falling rate of the waste plastic could be reduced.

Reference Example

In the cement kiln burner 1*b* illustrated in FIG. 8, the wind velocity adjusting member was provided and fixed in the straight outer flow channel 17, and the amount of the waste plastic was changed to confirm the maximum gas temperature in a kiln and the falling rate of the waste plastic.

The maximum gas temperature in the kiln is suitably 1860° C. to 1920° C. from the viewpoint of the heat resistance of bricks in the kiln and the quality of clinkers. The falling rate of the waste plastic is suitably 0% from the viewpoint of the quality of clinkers.

<Burner combustion conditions>, <Waste plastic conditions>, and <Secondary air conditions> are the same as in Example 1.

<Primary Air Conditions>

Based on Table 1 of Example 1, the position of the wind velocity adjusting member provided in the straight outer flow channel 17 was adjusted so that the wind velocity at the outlet of the burner was 400 m/s and 350 m/s.

<Evaluation Items>

The maximum temperature (° C.) of gas in the kiln and the falling rate (% by volume) of the waste plastic were subjected to simulation analysis. The evaluation results when the wind velocity at the outlet of the burner is 400 m/s are shown in Table 4, and the evaluation results when the wind velocity at the outlet of the burner is 350 m/s are shown in Table 5.

TABLE 4

| Wind velocity at outlet of burner: 400 m/s | | | | | | |
|---|---|---|---|---|---|---|
| | | Conditions | | Results | | |
| Level no. | Level name | Presence or absence of wind velocity adjusting member | Amount of waste plastic t/hr | Falling rate of waste plastic % by volume | Maximum gas temperature in kiln ° C. | Comment |
| 1 | Plastic 0 t/h | Presence | 0 | 0 | 2340 | Concern about erosion of bricks |
| 2 | Plastic 1 t/h | Presence | 1 | 0 | 2180 | Concern about erosion of bricks |
| 3 | Plastic 2 t/h | Presence | 2 | 0 | 2090 | Concern about erosion of bricks |
| 4 | Plastic 3 t/h | Presence | 3 | 0 | 1910 | Good (falling rate: 0% and within range of 1890° C. ± 30° C.) |

TABLE 5

| Wind velocity at outlet of burner: 350 m/s | | | | | | |
|---|---|---|---|---|---|---|
| | | Conditions | | Results | | |
| Level no. | Level name | Presence or absence of wind velocity adjusting member | Amount of waste plastic t/hr | Falling rate of waste plastic % by volume | Maximum gas temperature in kiln ° C. | Comment |
| 1 | Plastic 0 t/h | Presence | 0 | 0 | 2183 | Concern about erosion of bricks |
| 2 | Plastic 1 t/h | Presence | 1 | 0 | 1997 | Concern about erosion of bricks |
| 3 | Plastic 2 t/h | Presence | 2 | 0 | 1870 | Good (falling rate: 0% and within range of 1890° C. ± 30° C.) |
| 4 | Plastic 3 t/h | Presence | 3 | 9 | 1710 | Concern about deterioration in quality of crimpers |

When the wind velocity at the outlet of the burner shown in Table 4 was 400 m/s, the maximum temperature of gas in the kiln was within a range of 1890° C.±30° C., which was an appropriate temperature, under the condition that the amount of the waste plastic was 3 t/h, whereas when the amount of the waste plastic was less than 3 t/h, the maximum gas temperature increased to outside of the appropriate temperature range, which caused a concern about the erosion of refractory bricks. When the wind velocity at the outlet of the burner shown in Table 5 was 350 m/s, the maximum temperature of gas in the kiln was within the appropriate temperature range under the condition of the amount of the waste plastic of 2 t/h, whereas at the amount of the waste plastic of 3 t/h, the maximum gas temperature decreased to outside of the appropriate temperature range, which caused a concern about deterioration in the quality of clinkers. At the amount of the waste plastic of 1 t/h or less, the maximum temperature increased to outside of the appropriate temperature range, which caused a concern about the erosion of refractory bricks. Namely, it was suggested that the appropriate wind velocity at the outlet of the burner is present according to the amount of the waste plastic, which makes it possible to cope with various amounts of the waste plastic by adjusting the wind velocity at the outlet using the wind velocity adjusting member.

Example 2

Figure 9:
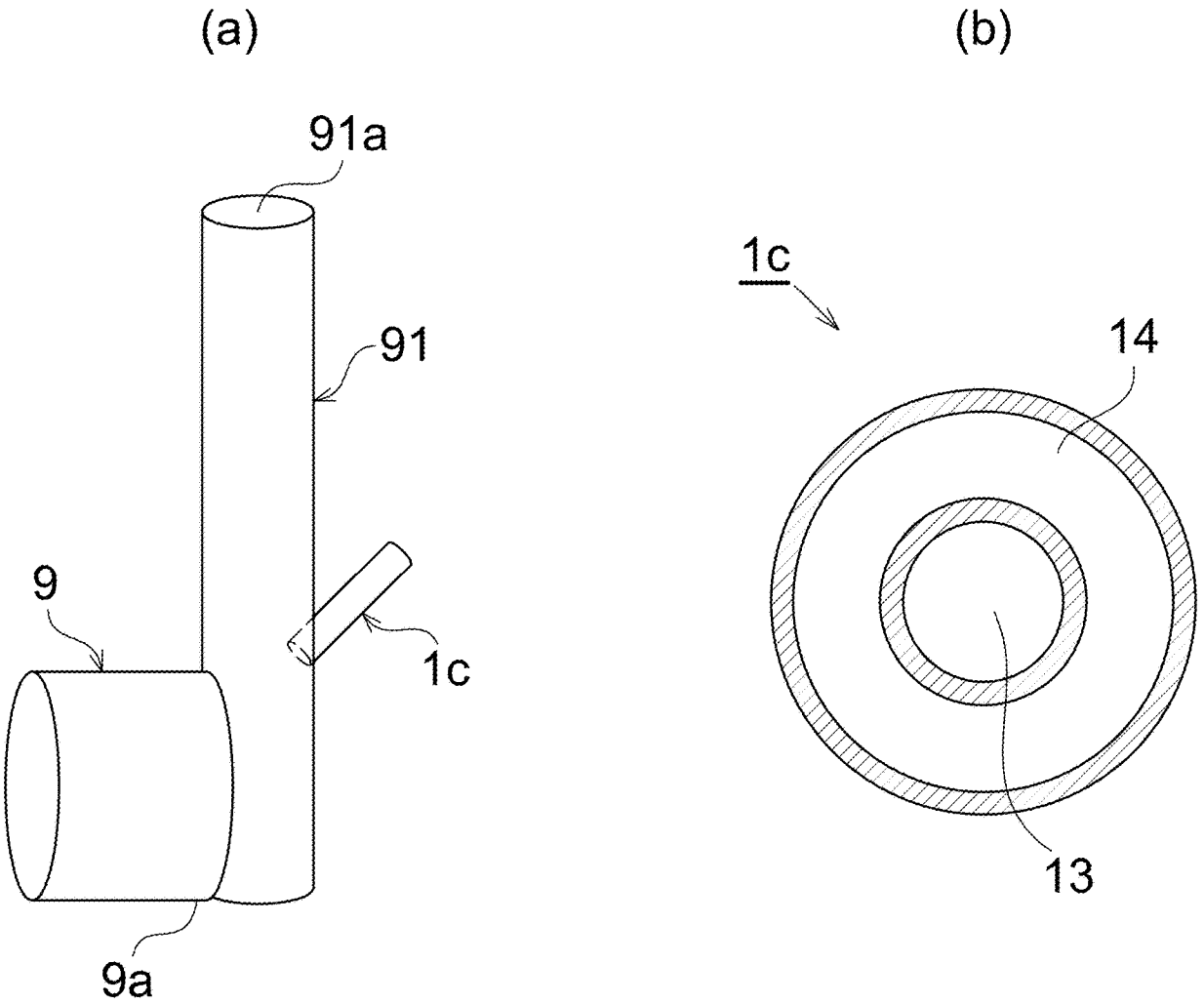
FIG. 9 is an overall view of a calcining furnace including a cement kiln burner according to Example 2 and a transverse cross-sectional view of the cement kiln burner.

A cement kiln burner 1*c* illustrated in FIG. 9 was analyzed. As illustrated in FIG. 9(*a*), the cement kiln burner 1*c* is a burner for a calcining furnace 91 installed at a kiln tail portion 9*a* of a cement kiln 9. The inner diameter of the cement kiln 9 was 3.5 m, and the inner diameter of the calcining furnace 91 was 2.0 m. As illustrated in FIG. 9(*b*), the cement kiln burner 1*c* includes a columnar pulverized coal flow channel 13 and a diffusion air flow channel 14 disposed adjacent to and outside the pulverized coal flow channel 13. A wind velocity adjusting member is not illustrated in FIG. 9.

<Burner Combustion Conditions>

Combustion amount of pulverized coal: 3 t/hour

<Secondary Air Conditions>

Amount and temperature of secondary air: 160,000 $Nm^3$/hour, 1000° C.

<Primary Air Conditions>

Using a wind velocity and a primary air ratio at the outlet of a burner in the following Table 6 as a base (specification), the wind velocity adjusting member provided inside the flow channel was moved from a position where the wind velocity adjusting member was pulled out by 0.5 m from the outlet of the burner to a position where the wind velocity adjusting member was pushed into the outlet (0 m) of the burner. The wind velocity adjusting member was provided in only one of the flow channels (13, 14), and moved. A wind velocity when the distance between the tip of the wind velocity adjusting member and the outlet of the burner was 0.5 m and a wind velocity when the distance between the tip of the wind velocity adjusting member and the outlet of the burner was 0 m were as shown in Table 7 below.

<Evaluation Items>

A pulverized coal combustion rate at an outlet 91*a* of the calcining furnace 91 when the distance between the tip of the wind velocity adjusting member and the outlet of the burner was changed was subjected to simulation analysis. The evaluation results of the pulverized coal combustion rate (% by weight) are shown in Table 8.

TABLE 6

| Flow channel name | Wind velocity at outlet of burner of base m/s | Primary air ratio % by volume | Swirl angle Degree |
|---|---|---|---|
| Pulverized coal flow channel | 50 | 2.0 | 0 |
| Diffusion air flow channel | 50 | 1.0 | 20 |

TABLE 7

| Flow channel name | Distance between tip of wind velocity adjusting member and outlet of burner: 0.5 m | 0 m |
|---|---|---|
| | Wind velocity at outlet of burner m/s | |
| Pulverized coal flow channel | 20 | 80 |
| Diffusion air flow channel | 20 | 80 |

TABLE 8

| Flow channel name | Combustion rate of pulverized coal [% by weight] — distance between tip of wind velocity adjusting member and outlet of burner [m] | | | | | | | |
|---|---|---|---|---|---|---|---|---|
| | 0.50 | 0.40 | 0.30 | 0.20 | 0.10 | 0.05 | 0.02 | 0.00 |
| Pulverized coal flow channel | 60 | 60 | 60 | 63 | 70 | 79 | 88 | 97 |
| Diffusion air flow channel | 60 | 60 | 62 | 67 | 79 | 90 | 100 | 100 |

As shown in Table 8, by advancing the wind velocity adjusting member toward the outlet side of the burner and increasing the wind velocity, the combustion of pulverized coal was promoted, and therefore the combustion rate of the pulverized coal could be increased.

DESCRIPTION OF REFERENCE SIGNS

1 Cement kiln burner
1*a* Cement kiln burner
1*b* Cement kiln burner
1*c* Cement kiln burner
2 Powdered-solid-fuel flow channel
2*t* Swirl vane
3 Oil flow channel
4 Combustible-solid-waste flow channel
5 Wind velocity adjusting member
5*a* Wind velocity adjusting member
5*b* lance-shaped member
9 Cement kiln
9*a* Kiln tail portion
11 First air flow channel
11*a* Inner peripheral wall of first air flow channel
11*b* Outer peripheral wall of first air flow channel
11*c* Outlet of first air flow channel
11*d* Outlet-side tip-end portion of first air flow channel
12 Second air flow channel
12*a* Inner peripheral wall of second air flow channel
12*b* Outer peripheral wall of second air flow channel
12*c* Outlet of second air flow channel
12*d* Outlet-side tip-end portion of second air flow channel
12*t* Swirl vane
13 Pulverized coal flow channel

14 Diffusion air flow channel
15 Swirl inner flow channel
16 Swirl outer flow channel
17 Straight outer flow channel
20 Cement kiln burner system
21 Pulverized-coal transfer pipe
22 Air pipe
23 Air pipe
24 Combustible-solid-waste transfer pipe
91 Calcining furnace
91*a* Outlet of calcining furnace

What is claimed is:

1. A cement kiln burner comprising a plurality of columnar or cylindrical flow channels, wherein outlets of the respective flow channels are disposed on substantially the same plane, and a wind velocity adjusting member capable of changing a cross-sectional area at an outlet-side tip-end portion of the flow channel by moving along an axial direction of the flow channel in a state of being in contact with one of an inner peripheral wall and an outer peripheral wall of the flow channel and not in contact with the other is provided inside at least one of the flow channels, wherein the wind velocity adjusting member is a circular tubular member whose inner diameter is the same as the diameter of the inner peripheral wall of the flow channel and whose outer diameter is smaller than the diameter of the outer peripheral wall of the flow channel, or whose outer diameter is the same as the diameter of the outer peripheral wall of the flow channel and whose inner diameter is larger than the diameter of the inner peripheral wall of the flow channel, and wherein each of the plurality of flow channels is provided with the wind velocity adjusting member.

2. The cement kiln burner according to claim 1, wherein at least one of the flow channels provided with the wind velocity adjusting member forms straight air flows.

3. The cement kiln burner according to claim 2, wherein the wind velocity adjusting member is provided inside a cylindrical flow channel positioned on an outermost side among the plurality of flow channels.

4. A method for operating a cement kiln burner according to claim 2, the method comprising:

reducing a cross-sectional area at a tip-end portion of the flow channel by advancing the wind velocity adjusting member toward the outlet side when increasing the wind velocity of the fluid blown out from the flow channel provided with the wind velocity adjusting member; and increasing the cross-sectional area at the tip-end portion of the flow channel by retracting the wind velocity adjusting member from the outlet side when decreasing the wind velocity of the fluid blown out from the flow channel.

5. The cement kiln burner according to claim 1, wherein at least one of the flow channels provided with the wind velocity adjusting member forms swirl air flows having a swirl angle of 1 to 60 degrees.

6. The cement kiln burner according to claim 5, wherein the wind velocity adjusting member is provided inside a cylindrical flow channel positioned on an outermost side among the plurality of flow channels.

7. A method for operating a cement kiln burner according to claim 5, the method comprising:

reducing a cross-sectional area at a tip-end portion of the flow channel by advancing the wind velocity adjusting member toward the outlet side when increasing the wind velocity of the fluid blown out from the flow channel provided with the wind velocity adjusting member; and increasing the cross-sectional area at the tip-end portion of the flow channel by retracting the wind velocity adjusting member from the outlet side when decreasing the wind velocity of the fluid blown out from the flow channel.

8. A method for operating a cement kiln burner according to claim 1, the method comprising:

reducing a cross-sectional area at a tip-end portion of the flow channel by advancing the wind velocity adjusting member toward the outlet side when increasing the wind velocity of the fluid blown out from the flow channel provided with the wind velocity adjusting member; and increasing the cross-sectional area at the tip-end portion of the flow channel by retracting the wind velocity adjusting member from the outlet side when decreasing the wind velocity of the fluid blown out from the flow channel.

9. A cement kiln burner comprising a plurality of columnar or cylindrical flow channels, wherein outlets of the respective flow channels are disposed on substantially the same plane, and a wind velocity adjusting member capable of changing a cross-sectional area at an outlet-side tip-end portion of the flow channel by moving along an axial direction of the flow channel in a state of being in contact with one of an inner peripheral wall and an outer peripheral wall of the flow channel and not in contact with the other is provided inside at least one of the flow channels, wherein at least one of the flow channels provided with the wind velocity adjusting member forms straight air flows, wherein each of the plurality of flow channels is provided with the wind velocity adjusting member.

10. A cement kiln burner comprising a plurality of columnar or cylindrical flow channels, wherein outlets of the respective flow channels are disposed on substantially the same plane, and a wind velocity adjusting member capable of changing a cross-sectional area at an outlet-side tip-end portion of the flow channel by moving along an axial direction of the flow channel in a state of being in contact with one of an inner peripheral wall and an outer peripheral wall of the flow channel and not in contact with the other is provided inside at least one of the flow channels, wherein at least one of the flow channels provided with the wind velocity adjusting member forms swirl air flows having a swirl angle of 1 to 60 degrees, wherein each of the plurality of flow channels is provided with the wind velocity adjusting member.

* * * * *